United States Patent [19]

Arita et al.

[11] Patent Number: 4,561,601

[45] Date of Patent: Dec. 31, 1985

[54] WINDING METHOD AND APPARATUS FOR MULTIFILAMENT FIBER BUNDLE

[75] Inventors: Yosihumi Arita; Kosuke Katsuki; Sadao Tabuchi, all of Ehime, Japan

[73] Assignee: Toray Industries, Inc., Tokyo, Japan

[21] Appl. No.: 584,359

[22] Filed: Feb. 28, 1984

[30] Foreign Application Priority Data

Mar. 2, 1983 [JP] Japan ..... 58-32943

[51] Int. Cl.[4] ..... B65H 54/02

[52] U.S. Cl. ..... 242/35.5 R; 242/115

[58] Field of Search ..... 242/35.5 R, 110, 115, 242/104

[56] References Cited

U.S. PATENT DOCUMENTS

| | | | |
|---|---|---|---|
| Re. 29,959 | 4/1979 | Schippers et al. | 242/35.5 R X |
| 1,422,954 | 7/1922 | Frazer | 242/104 |
| 2,563,642 | 8/1951 | Columbu et al. | 242/35.5 R |
| 3,429,745 | 2/1969 | Black | 242/35.5 R X |
| 3,801,242 | 4/1974 | Bauch | 242/35.5 R X |
| 4,079,898 | 3/1978 | Murakami et al. | 242/35.5 A |

*Primary Examiner*—Donald Watkins
*Assistant Examiner*—Katherine Jaekel
*Attorney, Agent, or Firm*—Armstrong, Nikaido, Marmelstein & Kubovcik

[57] ABSTRACT

A winding apparatus for multifilament fiber bundles wherein a plurality of fiber bundles are wound on a plurality of winders corresponding to each fiber bundle. A common waste yarn winder is provided independently from the winders, and the fiber bundles to be wound first are wound concurrently as waste yarn. Next, the fiber bundles being wound on the waste yarn winder are detached one by one sequentially from the waste yarn winder and then wound on the winders corresponding to each fiber bundle.

5 Claims, 6 Drawing Figures

Ya
Yb
Yc
Yd
Ya, Yb, Yc, Yd
Yw
1a
1b
1c
1d
2
3a
3b
3c
3d
4
5
5a
6
7
9
10
11
12
13
14
15
18

Ya
Yb
Yc
Yd
Ya,Yb,Yc,Yd
Yw
1a
1b
1c
1d
2
3a
3b
3c
3d
4
5
6
7
9
10
11
12
13
14
15
18

WINDING METHOD AND APPARATUS FOR MULTIFILAMENT FIBER BUNDLE

BACKGROUND

This invention relates to a winding method and apparatus for multifilament fiber bundles, and particularly to a method and apparatus for winding a plurality of tow carbon fiber bundles efficiently on a plurality of winders each.

When a plurality of filaments are each to be wound on bobbins on a winder (inclusive of a case where winding is recommenced by changing a filament from a fully wound bobbin to a new empty bobbin in a continuous winding process), it is necessary that a first part of the filament being wound be removed as a waste yarn. Such waste yarn has heretofore been sucked on an aspirator as disclosed in Japanese Patent Publication No. 29627/1979 or removed by winding it on a supplemental waste spool provided on a bobbin side of the winder as disclosed in Japanese Utility Model Publication No. 28849/1982.

However, if the above filament is a fiber bundle to which fibers are aggregated in a tow, and a plurality of the fiber bundles are wound concurrently on each winder, since the fiber bundle has a large volume as compared with a single filament, such an aspirator may become clogged and prevent a smooth winding operation. Then in the case where a waste spool is mounted individually on each winder, the capacity of the waste spool cannot be increased, and thus a waste yarn of the fiber bundle with large volume cannot be removed thoroughly. Moreover, it is a complicated and inefficient operation to remove the waste yarn at every winder and is particularly so in the case of a fiber bundle having large strength like a carbon fiber bundle, where the processes of cutting and removing waste yarn wound on the waste spool quickly dulls the edge of a cutter and the environment is polluted by the scattered chipped fibers.

SUMMARY OF THE INVENTION

An object of this invention is to provide a method and apparatus for winding multifilament fiber bundles which is more efficient for winding individual fiber bundles on a plurality of winders in a situation where a plurality of fiber bundles are wound concurrently.

Another object of this invention is to provide a method and apparatus for winding multifilament fiber bundles wherein the means to remove a waste yarn of a plurality of fiber bundles includes a common waste yarn winder large in winding capacity.

A further object of this invention is to provide a method for winding multifilament fiber bundle which is effective to facilitate removal of the waste yarn wound on a waste yarn winder, thereby promoting efficiency for continuous operation when changing from a fully wound bobbin to an empty bobbin.

Another further object of this invention is to provide a method for winding multifilament fiber bundles which is suitable for winding a plurality of tow carbon fiber bundles concurrently on a plurality of winders.

In order to attain the above-mentioned objects, in an arrangement for winding multifilament fiber bundles which may be used to wind a plurality of fiber bundles on a plurality of bobbin winders corresponding to each fiber bundle after the initial waste yarn is removed, the invention provides a common waste yarn winder which operates independently from the bobbin winders. The fiber bundles are initially wound concurrently on the common waste yarn winder, therefore the fiber bundles wound on the waste yarn winder are detached sequentially one by one from the waste yarn winder and wound on the winder corresponding to the fiber bundle.

THE PREFERRED EMBODIMENTS

Figures 1A, 1B:
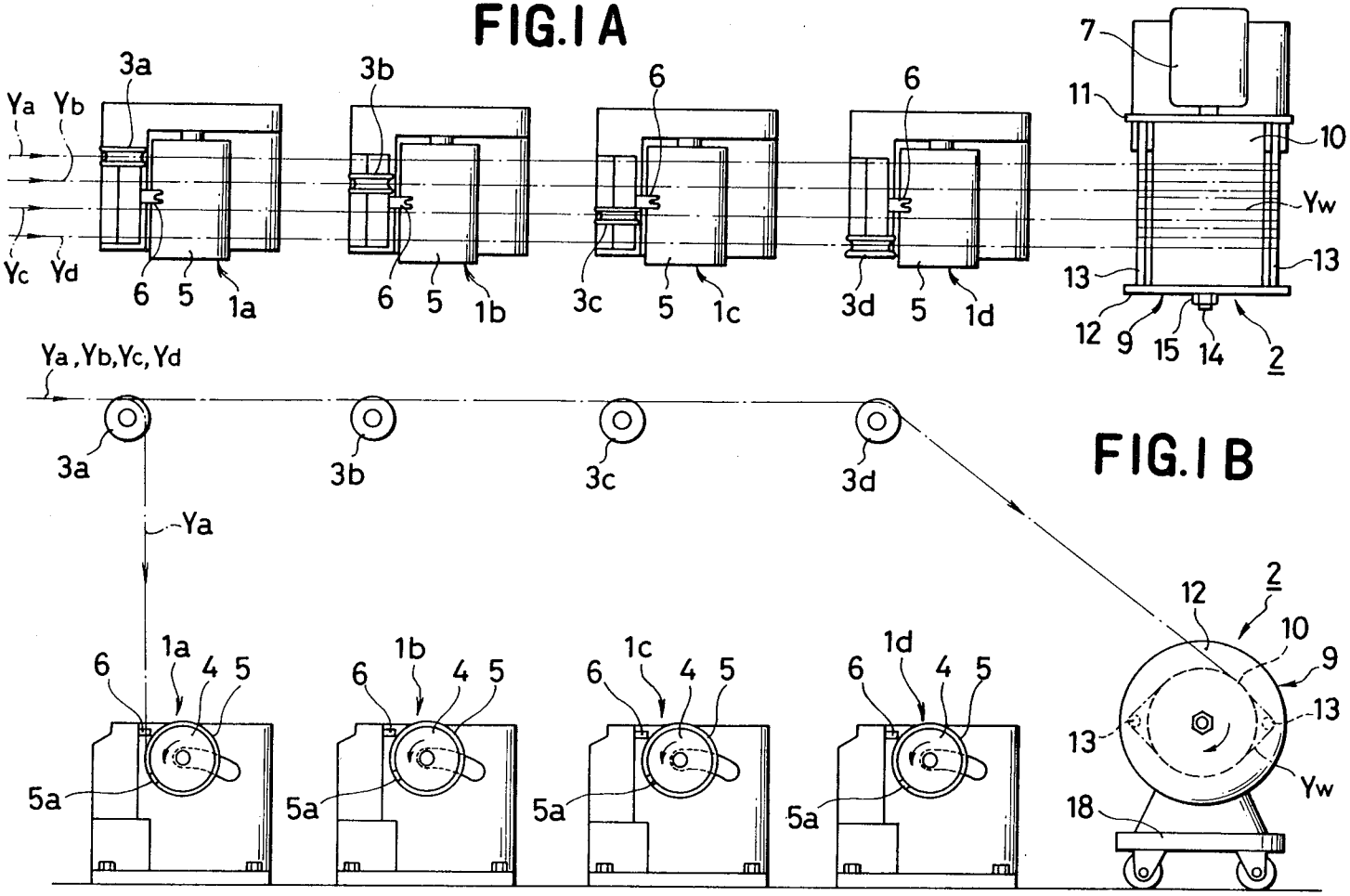
FIG. 1A is a plan view of a carbon fiber bundle winder for putting this invention into practice, illustrating a waste yarn removing process when winding is commenced.
FIG. 1B is a side view of a winder corresponding to FIG. 1A.

In FIGS. 1A to 2B, 1*a*, 1*b*, 1*c*, 1*d* denote winders for winding a plurality of carbon fiber bundles Ya, Yb, Yc, Yd respectively. The winders 1*a*, 1*b*, 1*c*, 1*d* are disposed in a row and fixed at predetermined intervals with winding axes parallel to each other. A waste yarn winder 2 is provided at the rear of the winder positioned at the end of the row in the direction of movement of the carbon fiber bundle. The carbon fiber bundles Ya, Yb, Yc, Yd are each formed in a tow to which a multitude of single fibers are aggregated. These fiber bundles are supplied in parallel, changed in direction through guide rollers 3*a*, 3*b*, 3*c*, 3*d* provided on the winders 1*a*, 1*b*, 1*c*, 1*d* with the path of each bundle bent, respectively in the direction of a winding axis and then wound on the winders 1*a*, 1*b*, 1*c*, 1*d* corresponding thereto.

The winders 1*a*, 1*b*, 1*c*, 1*d* have each a spindle 4 driven by a motor (not illustrated) and also a traverse guide 6 opposite to a bobbin 5 installed on the spindle 4 and reciprocating along the bobbin in the axial direction. With the guide rollers 3*a*, 3*b*, 3*c*, 3*d* working as a fulcrum point, the carbon fiber bundles Ya, Yb, Yc, Yd are traversed horizontally by the traverse guide 6 and thus wound on the bobbin 5. As regards the fulcrum point, another guide roller may be provided downstream of each of the guide rollers 3*a*, 3*b*, 3*c* and 3*d*. The spindle 4 gradually decreases its rotational speed so as to keep the winding speed constant as the size of the carbon fiber bundle wound on the bobbin 5 increases, and also leaves the traverse guide 6 following a circular arc path as indicated by a circular chain line at each of the winders 1*a*, 1*b*, 1*c*, 1*d* in FIG. 2B of the drawing.

Figure 3:
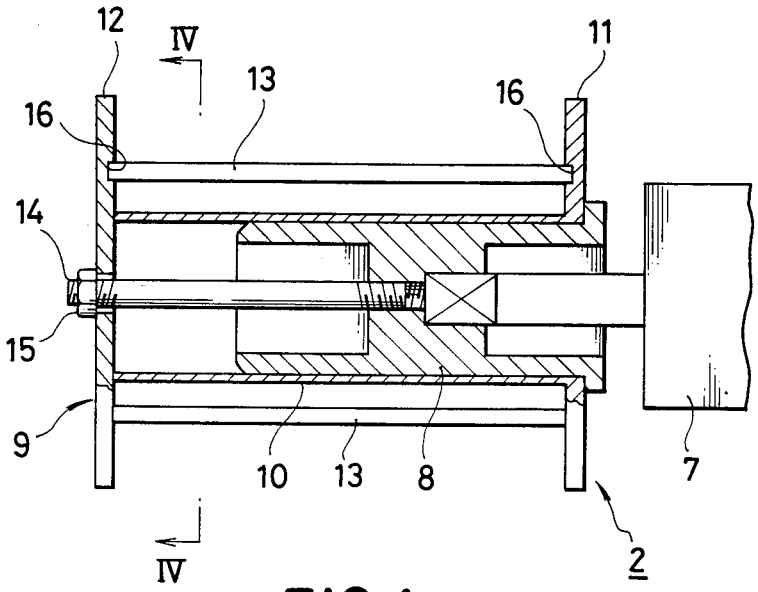
FIG. 3 is a front view, partly cut, of a main part of a waste yarn winder for the above winder.
Figure 4:
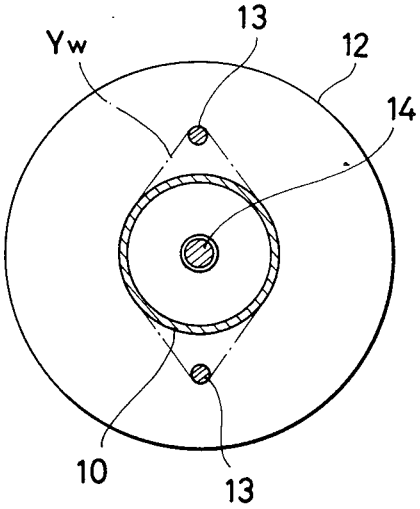
FIG. 4 is a sectional view taken on line IV—IV of FIG. 3.

As shown in FIGS. 3 and 4 in detail, the waste yarn winder 2 has a spindle 8 driven by a motor 7, and a bobbin 9 is installed detachably on the spindle 8. Further, these are mounted on a truck 18 and can be thus moved to an arbitrary position.

The bobbin 9 has a bobbin body 10 larger in outside diameter than the bobbin 5 on the side of the winders 1*a*, 1*b*, 1*c*, 1*d*, a flange 11 is fixed solidly on one end of the bobbin body 10, and another flange 12 is provided detachably on the other end thereof. Furthermore, yarn winding rod members 13, 13 extend between both flanges 11, 12 separated slightly from the surface of the bobbin body 10. Both ends of the yarn winding members 13 are fitted detachably in holes 16 perforated in the inside surface of the flanges 11, 12. A hole in the flange 12 allows the end of a bolt 14 fixed on the spindle 8 to pass through, where it is fastened and fixed by a nut 15 fitted on the end. Thus an arrangement is such that the yarn winding members 13 can also be detached from the flanges 11, 12 through detaching the flange 12 from the bobbin body 10 by removing the nut 15 from the bolt 14.

The carbon fiber bundles Ya, Yb, Yc, Yd are wound on the bobbin 9 made as mentioned above with the part of the filaments to wind first as waste yarn Yw in such manner as will cover both the surface of the bobbin body 10 and the yarn winding members 13, 13. It is desirable in this case that a winding rotational speed of the waste yarn winder 2 be controlled to come in the range of 0.5 to 20 m/min.

The waste yarn Yw wound on the waste yarn bobbin 9 in tension as described above will be loosened by detaching the yarn winding members 13 together with the flange 12, and therefore can be removed simply from the bobbin 9. Two yarn winding members 13 are shown in the example, however, it is possible to use only one, or three or more. Also, the yarn winding members 13 can be given the shape of an arc in section instead of the rod shape.

Further, the flange 11 of the bobbin 9 is fixed on the bobbin body 10, however, it can be made detachable like the flange 12.

Now in the above described winder, the carbon fiber bundles Ya, Yb, Yc, Yd to wind first will be wound on the winders 1*a*, 1*b*, 1*c*, 1*d* respectively as follows:

First, as shown in FIGS. 1A and 1B, the carbon fiber bundles Ya, Yb, Yc, Yd initially move in parallel and are guided by the guide rollers 3*a*, 3*b*, 3*c*, 3*d* and then wound straight on the bobbin 9 of the waste yarn winder 2 as the waste yarn Yw. Next, as the plurality of carbon fiber bundles, are being wound on bobbin 9 the carbon fiber bundle Ya is cut just before the waste yarn winder 2, and the upstream end of the cut carbon fiber bundle Ya is hung on a notch 5*a* at an end of the bobbin 5 of the winder 1*a*. The carbon fiber bundle Ya is thus ready for winding on the winder 1*a*.

Figures 2A, 2B:
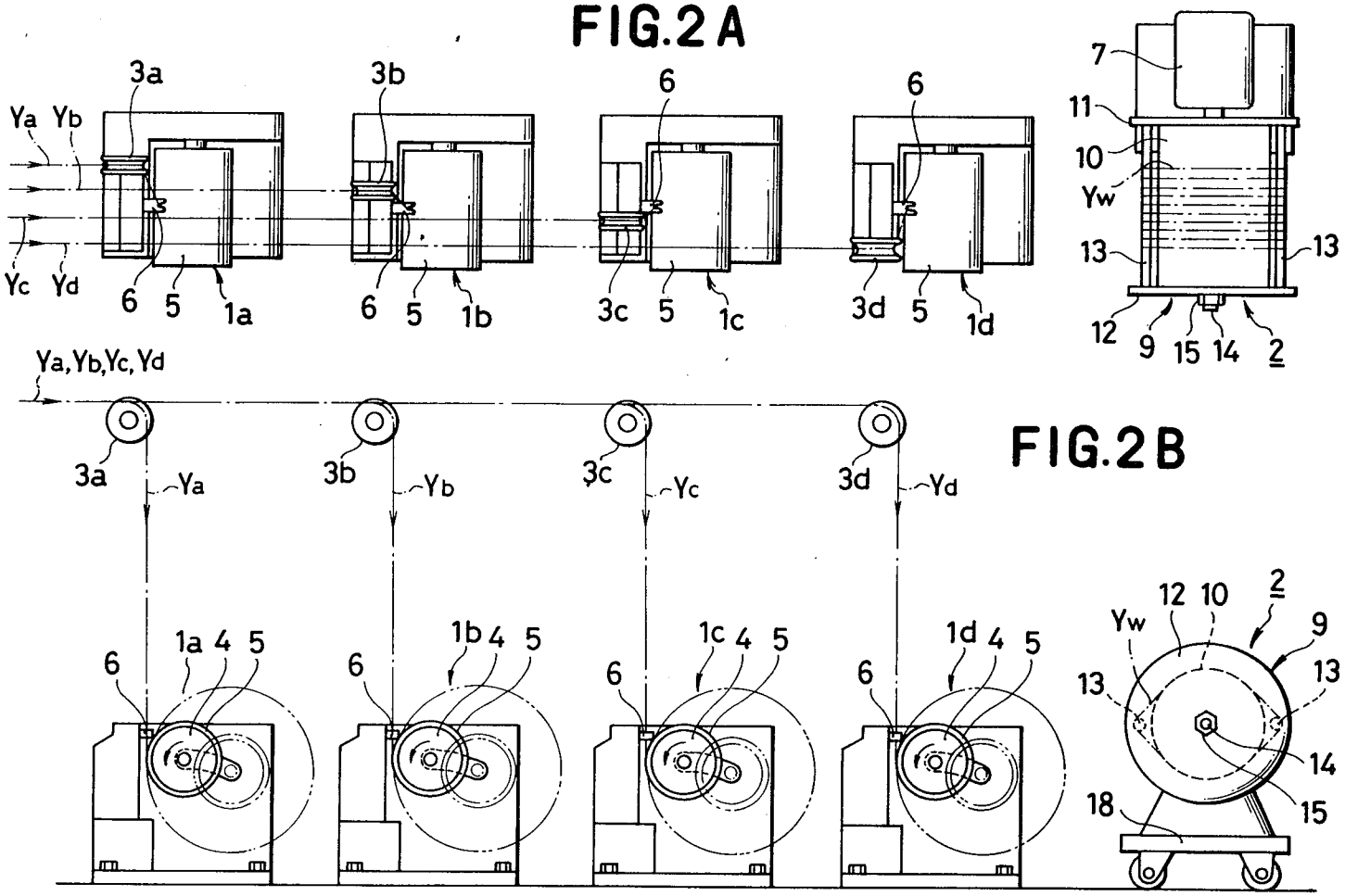
FIG. 2A is a plan view of the winder same as above, illustrating a state wherein the process has just been transferred from waste yarn removing of FIGS. 1A and 1B to winding.
FIG. 2B is a side view of the winder corresponding to FIG. 2A.

Next, the remaining carbon fiber bundles Yb, Yc, Yd are subjected one by one sequentially to the operation same as above on the winders 1*b*, 1*c*, 1*d* corresponding to each fiber bundle, thereby obtaining the winding state finally as shown in FIGS. 2A, 2B.

Whenever the above operation is over on all the winders 1*a*, 1*b*, 1*c*, 1*d*, the waste yarn Yw wound on the bobbin 9 of the waste yarn winder 2 is removed. Since the waste yarn winder 2 is provided as that for common use on all the carbon fiber bundles Ya, Yb, Yc, Yd independently from the winders 1*a*, 1*b*, 1*c*, 1*d*, it is not necessary that the waste yarn removing operation be carried out at every guide operations on the winders 1*a*, 1*b*, 1*c*, 1*d*. Further, the waste yarn can be removed from the bobbin 9 at any selected time regardless of the yarn guide operation, therefore no restriction will be placed on time. The transfer of winding operation to the empty bobbin when winding is commenced can therefore be accomplished efficiently. Particularly where a continuous winding operation is carried out by changing the winding from the full wound bobbin to the new empty bobbin, the waste yarn can be removed independently from changing the winding, therefore the time necessary for the change can be shortened to increase the efficiency of the operation.

On the other hand, since the waste yarn winder 2 works independently, the diameter of the bobbin body 10 of the bobbin 9 can be made large regardless of the diameter of the bobbin 5 for the winders 1*a*, 1*b*, 1*c*, 1*d*. Consequently, the winding capacity of the waste yarn can be increased, and hence no trouble will be incurred to a fiber bundle large in denier due to a shortage of waste yarn winding capacity.

Further, the waste yarn winder 2 is movable on a truck 18, therefore it can be moved to any selected place for winding operation of the waste yarn and/or removing operation after winding, thus further promoting the efficiency of the winding operation.

The bobbin 9 of the waste yarn winder 2 is made with the flange 12 and the yarn winding member 13 detachable from the bobbin body 10, therefore the waste yarn Yw wound in tension on the bobbin 9 can be removed simply without using a cutter such as knife or the like.

Further, in the above described example, the description has referred to the winding of carbon fiber bundles, however, the invention can be applied also to the winding of other fiber bundles. Besides, the case where four fiber bundles are wound each on four winders has been described, however, the invention can also be applied to a plurality of fiber bundles and a plurality of winders.

We claim:

1. Apparatus for winding a plurality of multifilament fibers on a plurality of bobbins comprising:

a plurality of winders disposed in a row and fixed at predetermined intervals;

each of said winders having a motor driven spindle, the axes of said spindles being parallel to each other, and having a bobbin installed on each spindle;

a plurality of guide rollers for carrying said fibers moving lengthwise down said row, one of said guide rollers being positioned adjacent to each of said winders so that each fiber passing lengthwise along said row of winders may bend around one of said guide rollers to extend in the direction of one of said winders to be wound thereon; and a common waste yarn winder provided independently of said winders and positioned at the downstream end of said row of winders in the direction of movement of said fibers, said fibers to be wound on said winders each passing over one of said guide rollers and initially extending the full length of said row to be attached to said waste yarn winder to be wound on said waste yarn winder, whereby each of said fibers may be individually sequentially cut from said waste yarn winder and be attached to the bobbin of a respective winder adjacent to its initial path of movement for winding thereon.

2. An apparatus as claimed in claim 1, wherein said waste yarn winder is provided with a truck whereby it can be moved to any selected position for winding yarn thereon or removal of waste yarn therefrom.

3. An apparatus as claimed in claim 1, wherein said waste yarn winder is independently driven to wind the waste yarn thereon at a winding speed in the range of 0.5 to 20.0 m/min.

4. An apparatus as claimed in claim 1, wherein said waste yarn winder has a winding bobbin provided with a detachable flange at one end thereof to permit easy removal of said waste yarn.

5. An apparatus as claimed in claim 1, wherein said waste yarn winder has a bobbin for winding waste yarn that is substantially larger than said bobbins of said plurality of winders.

* * * * *